United States Patent [19]

Croudace et al.

[11] Patent Number: 4,844,717

[45] **Date of Patent: * Jul. 4, 1989**

[54] FUEL COMPOSITION AND METHOD FOR CONTROL OF ENGINE OCTANE REQUIREMENTS

[75] Inventors: Michael C. Croudace, Santa Ana; Timothy Wusz; Stephen Brass, both of Fullerton, all of Calif.

[73] Assignee: Union Oil Company of California, Los Angeles, Calif.

[ * ] Notice: The portion of the term of this patent subsequent to May 10, 2005 has been disclaimed.

[21] Appl. No.: 185,148

[22] Filed: Apr. 22, 1988

Related U.S. Application Data

[63] Continuation-in-part of Ser. No. 897,015, Aug. 15, 1986, Pat. No. 4,743,273.

[51] Int. Cl.[4] ..... C10L 1/18; C10L 1/22

[52] U.S. Cl. ..... 44/71; 44/77; 44/78; 123/1 A

[58] Field of Search ..... 44/71, 77; 123/1 A

[56] References Cited

U.S. PATENT DOCUMENTS

| | | | |
|---|---|---|---|
| 2,100,287 | 11/1937 | Conquest | 44/9 |
| 2,176,747 | 0/0000 | Schneider et al. | 44/9 |
| 2,210,942 | 8/1940 | Lipkin | 44/9 |
| 2,225,942 | 12/1940 | Schneider et al. | 44/9 |
| 2,706,677 | 4/1955 | Duncan et al. | 44/71 |
| 2,918,359 | 12/1959 | Lovett et al. | 44/56 |
| 3,144,311 | 8/1964 | Armstrong et al. | 44/63 |
| 3,146,203 | 8/1964 | Frew, Jr. | 252/4.99 |
| 3,506,416 | 4/1970 | Patinkin et al. | 44/69 |
| 3,756,794 | 9/1973 | Ford | 44/51 |
| 3,778,372 | 12/1973 | Murphy | 252/51.5 A |
| 3,817,721 | 6/1974 | Perilstein | 44/69 |
| 4,217,111 | 8/1980 | Frost, Jr. | 44/71 |
| 4,264,335 | 4/1981 | Bello et al. | 44/68 |
| 4,270,930 | 6/1981 | Campbell et al. | 44/71 |
| 4,357,148 | 11/1982 | Graiff | 44/62 |
| 4,428,754 | 1/1984 | Smith | 44/56 |
| 4,444,565 | 4/1984 | Croudace | 44/68 |
| 4,743,273 | 5/1988 | Croudace et al. | 44/71 |

*Primary Examiner*—William R. Dixon, Jr.
*Assistant Examiner*—E. McAvoy
*Attorney, Agent, or Firm*—Gregory F. Wirzbicki

[57] ABSTRACT

The octane requirement increase phenomenon in a spark ignition internal combustion engine is controlled by introducing with the combustion charge a fuel composition containing an octane requirement increase-inhibiting amount of a combination of compounds, the combination comprising a first compound being (1) a gasoline soluble amide and (2) a second compound being a gasoline soluble ketone. Usually the first and second compounds are each added to the fuel in an amount between about 0.001 and 3 weight percent of the fuel. In particular, the combination of N,N-dibutyl formamide and either benzophenone or methylcyclohexanone provides an effective octane requirement increase-inhibiting additive for unleaded gasoline.

43 Claims, No Drawings

FUEL COMPOSITION AND METHOD FOR CONTROL OF ENGINE OCTANE REQUIREMENTS

CROSS-REFERENCE TO RELATED APPLICATIONS

This application is a continuation-in-part of U.S. Pat. application Ser. No. 897,015 filed Aug. 15, 1986, now U.S. Pat. No. 4,743,273, which application is herein incorporated by reference in its entirety.

BACKGROUND OF THE INVENTION

This invention relates to improved hydrocarbon fuels which control the octane requirement increase (ORI) phenomenon observed during the initial portion of the operating life of spark ignition internal combustion engines.

The octane requirement increase (ORI) effect exhibited by internal combustion engines, e.g., spark ignition engines, is well known in the art. This effect may be described as the tendency for an initially new or clean engine to require higher octane quality fuel as operating time accumulates and is coincidental with the formation of deposits in the region of the combustion chamber of the engine. Thus, during the initial operation of a new or clean engine, a gradual increase in octane requirement (OR), the fuel octane number required for knock-free operation, is observed, accompanied by an increasing buildup of combustion chamber deposits until a rather stable or equilibrium OR level is reached. At the equilibrium OR level the accumulation of deposits on the combustion chamber surfaces no longer increases, but remains relatively constant. This so-called "equilibrium value" is usually reached between about 3,000 and 20,000 miles or the corresponding hours of operation. The actual equilibrium value of this increase can vary with engine design and even with individual engines of the same design; however, in almost all cases the increase appears to be significant. ORI values ranging from about 2 to 14 Research Octane Numbers (RON) are commonly observed in modern engines.

It is known that additives may prevent or reduce deposit formation, or remove or modify formed deposits, in the combustion chamber and adjacent surfaces and hence decrease OR. Such additives are generally known as octane requirement reduction (ORR) additives.

For example, in U.S. Pat. No. 4,264,335 to Bello et al., the cerous or ceric salt of 2-ethylhexanoate is disclosed as a useful additive for suppressing the octane requirement increase of a gasoline fired internal combustion engine. It is noted in this patent that the above salt has no effect on combustion efficiency of a gasoline and does not provide anti-knock properties.

In U.S. Pat. No. 4,357,148 to Graiff an additive is disclosed for controlling or reversing the octane requirement increase of a spark ignition internal combustion engine which comprises a combination of (a) certain oil-soluble aliphatic polyamines and (b) certain low molecular weight polymers and/or copolymers of monoolefins having up to 6 carbon atoms.

U.S. Pat. No. 3,506,416 to Patinkin et al. discloses an additive to inhibit octane requirement increase of a spark ignition engine which comprises a gasoline soluble metal salt of a hydroxamic acid. This additive is disclosed as useful in leaded gasolines. Nickel and cobalt are especially preferred as the additives. In U.S. Pat. No. 4,444,565 to Croudace, on the other hand, an oil-soluble iron compound in combination with a carboxylic acid or ester is added to the combustion intake charge of an internal combustion engine to suppress the octane requirement increase. And U.S. Pat. No. 4,217,111 to Frost, Jr., discloses a fuel composition containing gasoline and an octane requirement moderating additive comprising a dialkyl formamide of 7 to 11 carbon atoms.

Other references describing additives for inhibiting octane requirement incresase include U.S. Pat. Nos. 3,144,311 and 3,146,203, which disclose utilization of nitrogen ring compounds in combination with an organo metallic primary anti-knock agent and a minor amount of an ignition control additive selected from the group consisting of phosphorus and boron compounds. And U.S. Pat. No. 3,817,721 discloses the use of high molecular weight alkyl aromatic hydrocarbons, or mixtures thereof, for reducing intake valve deposits formed in a spark ignition gasoline fueled internal combustion engine.

In addition to the foregoing, another known additive for inhibiting ORI is polyaminopolyether carbamate, marketed commmercially as Techron, by Chevron Oil Company, and described more fully in U.S. Pat. No. 4,270,930 to Campbell et al. Techron is the industry standard for ORI inhibition, but improvements beyond those afforded by Techron are still being sought. In particular, additives are needed which provide either more inhibition of ORI in engines and/or more reduction in engine OR from their "equilibrium values." More particularly still, an additive is needed which will provide such inhibition or reduction at relatively low concentrations in gasoline.

SUMMARY OF THE INVENTION

It has now been found that a significant reduction in ORI is produced when a minor amount is dissolved in gasoline of an additive comprising a combination of compounds, said combination comprising (1) a gasoline soluble amide, most preferably selected from the group consisting of acetamides and formamides having the formula

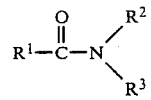

wherein $R^1$ is hydrogen or a methyl group and $R^2$ and $R^3$ are gasoline solubilizing organic radicals having a total between them of between 2 and 20 carbon atoms and (2) a gasoline soluble ketone, preferably selected from the group consisting of unsubstituted and alkyl and polyalkyl substituted cycloalkanones and aromatic ketones.

In engines in which the "equilibrium value" of octane requirement has been reached, the octane requirement of the engine can be reduced from the "equilibrium value" by use of a fuel containing the amide-ketone additives of this invention. Alternatively, for those engines which have not yet reached their equilibrium OR value, the fuels of the present invention are effective in reducing the OR value and/or inhibiting any further increase in the OR value.

Accordingly, the invention provides a method for operating a spark ignition internal combustion engine which comprises introducing with the combustion intake charge to the engine an octane requirement increase-inhibiting or octane requirement reducing amount of a combination of compounds comprising a gasoline soluble amide and a gasoline soluble ketone.

The invention further provides a motor fuel composition comprising a mixture of hydrocarbons boiling in the gasoline range, usually from about 25° C. (77° F.) to about 225° C. (437° F.), containing an octane requirement increase-inhibiting amount of an additive comprising the above combination of an amide and a ketone.

Further provided according to the invention is an octane requirement increase-inhibiting additive concentrate comprising (a) from about 1 to about 500 grams per gallon of the above described combination of an amide and a ketone and (b) the balance consisting essentially of a fuel-compatible diluent boiling in the range from about 25° C. (77° F.) to about 225° C. (437° F.).

DETAILED DESCRIPTION OF THE INVENTION

The combination of compounds herein can be added with success to either leaded or unleaded gasolines, such as those used in automobiles having catalytic converters, but unleaded gasolines are preferred. An unleaded gasoline as herein defined is a gasoline containing less than 0.05 grams of lead per gallon (0.0132 gm/1).

In the practice of this invention octane requirement increase caused by combustion of gasolines in a spark ignition internal combustion engine is suppressed or reversed by introducing with the combustion charge a fuel composition containing a combination of (1) at least one gasoline soluble amide compound, most preferably selected from the group consisting of acetamides and formamides of the formula

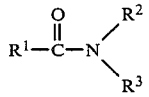

wherein $R^1$ is hydrogen or a methyl group and $R^2$ and $R^3$ are gasoline solubilizing radicals, said radicals having a total of between 2 and 20 carbon atoms, and (2) at least one gasoline soluble ketone compound preferably selected from the group consisting of gasoline soluble unsubstituted and alkyl and polyalkyl substituted cycloalkanones and aromatic ketones.

The typical amide compounds for use in the invention are gasoline-soluble and of formula:

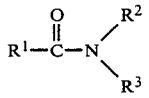

wherein $R^1$, $R^2$, and $R^3$ are independently hydrogen or organic radicals, provided that at least one of $R^1$, $R^2$, and $R^3$ is an organic radical. If any or all of $R^1$, $R^2$, and $R^3$ is (are) chosen to be an organic radical, the organic radical(s) will individually usually contain no more than about 40 carbon atoms, and although the organic radicals may contain aromatic groups, it is preferred that the $R^1$, $R^2$, and $R^3$ radicals all be devoid of such groups, i.e., that they be aliphatic. In addition, although each of $R^1$, $R^2$, and $R^3$ may be unsaturated aliphatic groups, e.g., alkenyl and alkynyl groups, it is most preferred, when $R^1$, $R^2$, and $R^3$ are chosen to be organic groups, that they be substituted or unsubstituted alkyl radicals, and more preferably still, unsubstituted alkyl radicals (including cycloalkyl radicals).

As stated above, $R^1$ of the most preferred amide is hydrogen or a methyl group, and $R^2$ and $R^3$ are gasoline-solubilizing organic radicals, totalling 2 to 20 carbon atoms, such as substituted or unsubstituted alkyl, aryl, arylalkyl, alkyloxy, aryloxy, arylalkyloxy, alkenyl, alkenyloxy, alkynyl, alkynloxy, and arylalkenyl radicals and heteroatom-substituted hydrocarbyl radicals wherein the heteroatoms are selected from the group consisting of oxygen, sulfur, and nitrogen atoms. More preferably, however, the gasoline-solubilizing radicals of the most preferred amide are unsubstituted alkyl radicals, e.g., of 1 to 10 carbon atoms, and more preferably still, unsubstituted alkyl radicals of 2 to 5 carbon atoms.

Examples of amide compounds suitable for use in this invention are N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N-ethyl-N-decyl acetamide, N,N-dibutyl acetamide, N,N-dipropyl acetamide, N-nonyl-N-decyl acetamide, and the like. As will be seen by those skilled in the art, the foregoing compounds contain a normal alkyl group for $R^2$ and $R^3$ of the above formula. However, these groups could also be branched-chain radicals such as isopropyl, isobutyl, tertiary butyl, isoamyl, etc. But the most preferred amide compound is N,N-dibutyl formamide.

The ketone compounds for use in the invention are those which are gasoline soluble. Their general formula conforms to either:

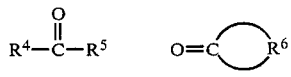

(I) (II)

wherein $R^4$ and $R^5$ are monovalent organic radicals, and $R^6$ is a divalent organic radical, with the ketone (whether of formula (I) or formula (II)) usually having no more than about 75 carbon atoms, preferably no more than about 50 carbon atoms. $R^4$, $R^5$, and $R^6$ may be either aliphatic or aromatic, with a radical containing an aromatic group being defined herein as an aromatic radical. If $R^4$, $R^5$, or $R^6$ is aliphatic, it may be, for example, a substituted or unsubstituted alkyl, alkenyl, or alkynyl group, with alkyl groups being the most preferred aliphatic radical. If $R^4$ and $R^5$ are alkyl groups, the resulting compound, of course, is an alkylketone, and if $R^6$ is an alkyl group, the compound becomes a cycloalkylketone. Either or both of $R^4$ and $R^5$ may be an aromatic radical, and $R^4$ and $R^5$ may be aromatic radicals wherein a straight or branched chain or a cyclic groups bears an aromatic group, this, of course, being the only possibility open for $R^6$, when $R^6$ is chosen to be aromatic. If both $R^4$ and $R^5$ are aromatic radicals, they usually and preferably are either both phenyl radicals (in which case the resulting compound is benzophenone), or one may be a phenyl radical and the other an alkyl substituted phenyl radical, or both may be alkyl-substituted phenyl radicals.

In the most preferred embodiment of the present invention, one selects either a formula (I) compound with both $R^4$ and $R^5$ being aromatic radicals or a formula (II) compound with $R^6$ being an unsubstituted alkyl group or an alkyl or polyalkylsubstituted alkyl group.

Examples of suitable ketones for use in the invention are 2-pentanone, 1-penten-3-one, 1-pentyn-3-one, 2-hexanone, acetone, 2-butanone, ethylacetoacetone, 2-decanone, 4-decanone, 3-heptanone, 1-hexen-3-one, 5-hexen-2-one, 2-pentanone, and 1-hexyn-3-one.

Examples of the most preferred gasoline soluble ketone compounds for use in the invention are the unsubstituted and alkyl or polyalkyl substituted cycloalkanones, (such as pentanones), typically having between 4 and 8 carbon atoms in the ring structure, and aromatic ketones (such as phenones) having a total of between 1 and 25 carbon atoms in the substitutents thereto, with there typically being no more than about a total of 20 carbon atoms in all such substituents. Examples of the most preferred ketone compounds for use in this invention, therefore, are methylcyclohexanone, ethyl-methyl benzophenone, propyl-butyl benzophenone, dimethyl benzophenone, cyclopentanone, trimethyl benzophenone, ethyl-methyl cyclopentanone, propyl-butyl cyclopentanone, dibutyl cyclopentanone, and the like. The most preferred ketones for use herein are methylcyclohexanone and benzophenone.

Thus, in the most preferred embodiment the combination of compounds contemplated herein comprises N,N-dibutyl formamide as the amide compound and methylcyclohexanone or benzophenone as the ketone.

In the foregoing discussion, the term "organic radical" refers to any group containing at least one carbon atom. Included therefore are aliphatic and aromatic radicals, whether containing only hydrogen and carbon (i.e., hydrocarbon radicals) or further containing heteroatoms such as oxygen, phosphorus, sulfur, and nitrogen and/or an inorganic substituent such as chlorine, bromine, iodine, etc. Accordingly, typical groups for $R^1$ to $R^6$ include substituted or unsubstituted alkyl, aryl, arylalkyl, alkyloxy, aryloxy, arylalkyloxy, alkenyl, alkenyloxy, alkynyl, alkynloxy, and arylalkenyl radicals and heteroatom-substituted hydrocarbyl radicals wherein the heteroatoms are selected from the group consisting of oxygen, sulfur, and nitrogen atoms. It is, of course, most highly preferred that all of $R^1$ through $R^6$, when selected to be organic, should be hydrocarbon radicals, and particularly alkyl or cycloalkyl groups for $R^1$, $R^2$, $R^3$, and $R^6$ and phenyl radicals or phenyl radicals bonded to alkyl groups for $R^4$ and $R^5$.

The concentration of each of the compounds comprising the combination additive provided in fuels according to this invention is usually between about 0.001 and 3.0 weight percent, making a total combinative additive concentration between about 0.002 and 6.0 weight percent. At a level lower than about 0.002 weight percent in fuel, the desired inhibition of the octane requirement increase usually is not observed. The upper level for the concentration of the combination additive is usually selected to balance the cost of the combination additive with a decreasing efficiency for reducing the octane requirement increase. In the preferred embodiment, when the combination of an amide and cycloalkanone is used, the concentration of both the amide and the cycloalkanone in the fuel is between about 0.05 and 1.0 weight percent. However, when the combination comprises an amide and aromatic ketone, the preferred concentration of the amide is between 0.05 and 1.0 weight percent and the preferred concentration of the aromatic ketone in the fuel is between about 0.05 and 0.5 weight percent. Higher concentrations, of course, can be used, but it has been found that using a concentration of benzophenone greater than about 0.5 weight percent can result in a build up of deposits in the engine rather than a reduction in octane requirement. Whether this result is characteristic of all aromatic ketones, or benzophenone specifically, has not as yet been determined.

Suitable liquid hydrocarbon fuels of the gasoline boiling range as described in ASTM D-439 are mixtures of hydrocarbons boiling in the range from about 25° C. (77° F.) to about 225° C. (437° F.), and often comprise mixtures of saturated hydrocarbons, olefinic hydrocarbons and aromatic hydrocarbons. Preferred are gasoline blends consisting of or consisting essentially of a saturated hydrocarbon content ranging from about 40 to about 80 percent by volume, an olefinic hydrocarbon content from about 0 to about 30 percent by volume and an aromatic hydrocarbon content ranging from about 10 to about 60 percent by volume. The base fuel can be derived from straight run gasoline, polymer gasoline, natural gasoline, dimer and trimerized olefins, synthetically-produced hydrocarbon mixtures, from thermally or catalytically reformed hydrocarbons, or from catalytically cracked or thermally cracked petroleum stocks, and mixtures of these. The hydrocarbon composition and octane level of the base fuel are not critical. Any conventional motor fuel base may be employed in the practice of this invention.

Normally, the hydrocarbon fuel mixtures to which the invention is applied may contain minor amounts of blending agents such as methanol, ethanol, methyl tert butyl ether, and the like. The fuels may also contain antioxidants such as phenolics, e.g., 2,6-di-tert-butylphenol or phenylenediamines, metal deactivators, antiknock compounds such as tetraethyl lead, a methyl cyclopenta dienylmanganese tricarbonyl, ortho-azidophenol and the like. However, the preferred fuels are unleaded fuels and thus contain no added tetraethyl lead.

The octane requirement reduction addituve of the present invention can be introduced into the combustion zone of the engine in a variety of ways to prevent buildup of deposits, or to accomplish reduction or modification of deposits. Thus the ORR additive can be injected into the intake manifold intermittently or substantially continuously, preferably in a hydrocarbon carrier having a final boiling point (by ASTM D86) lower than about 225° C. (437° F.). A preferred method is to dissolve the additive in the fuel, either by blending the additive separately into the fuel or with other fuel additives.

The invention further provides a concentrate for use in liquid hydrocarbon fuel in the gasoline boiling range comprising (a) from about 1 to 500 grams per gallon of the hereinabove described oil-soluble, amide-ketone combination, (b) optionally from about 0.01 to 0.2 weight percent of a dehazer and (c) the balance consisting essentially of a diluent, boiling in the range from about 25° C. (77° F.) to about 225° C. (437° F.). Typical diluents include hydrocarbons and oxygen-containing hydrocarbons. Suitable oxygen-containing hydrocarbon diluents include, e.g., methanol, ethanol, propanol, methyl tert-butyl ether and ethylene glycol monobutyl ether. The hydrocarbon diluent may be an alkane such as heptane but preferably is an aromatic hydrocarbon, such as toluene or xylene, alone or in admixture with said oxygen-containing hydrocarbon diluents. The optional dehazer is usually a polyester-type ethoxylated alkylphenolformaldehyde resin, but is not specifically limited thereto.

The following examples demonstrate the surprising suppression of octane requirement increase when utilizing an additive comprising the amide-ketone combination in a fuel for a spark ignited internal combustion engine. These examples are meant to be illustrative of the instant invention and not intended to limit the scope of the appended claims.

EXAMPLE 1

An initially clean 1973 350 CID V8 Chevrolet engine is utilized to compare the additive of the instant invention for the inhibition of octane requirement increase with Techron, a polyaminopolyether carbamate manufactured by Chevron Oil Company. The additives are added to the gasoline described in Table 1.

TABLE 1

GASOLINE FUEL CHARACTERISTICS

| Characteristic | | |
|---|---|---|
| Gravity @ 60° F. (15.6° C.) (°API) | | 55.9 |
| Research Octane No. | | 94.4 |
| Motor Octane No. | | 84.6 |
| Reid Vapor Pressure, psi | | 8.7 |
| atm | | 1.6 |
| FIA (D 1319) wt % | | |
| Aromatics | | 33.0 |
| Olefins | | 6.5 |
| Saturates | | 60.5 |
| Distillation (D 86) °F. (°C.) | | |
| Initial | 96 | (35.6) |
| 10% | 125 | (51.7) |
| 30% | 184 | (84.4) |
| 50% | 225 | (107.2) |
| 70% | 266 | (130.0) |
| 90% | 334 | (167.8) |
| 95% | 360 | (182.2) |
| End Point | 420 | (215.6) |
| Sulfur (ppm) | 250 | |
| % Carbon | 86.5 | |

As a carburetor cleanliness additive, oleylamine is added in a concentration of 14 pounds per thousand barrels.

The test consists of two parts, a deposit accumulation phase and a rating phase. During the deposit accumulation phase of the test, the engine is run on the cycle described in Table 2. It is noted that, during this test, the water temperature out of the engine was 185° F. (85° C.) and the oil sump temperature was between 200° C.) and 250° F. (93° and 121° C.).

TABLE 2

| Step | Time Min | RPM | Speed MPH | Speed (km/hr) | Load BHP* |
|---|---|---|---|---|---|
| 1 | 2 | 700 | idle | | 3 |
| 2 | 3 | 1700 | 45 | (72) | 15 |
| 3 | 4 | 1200 | 35 | (56) | 7 |
| 4 | 0.1 | 2225 | 60 | (97) | 100 |
| 5 | 3 | 2400 | 65 | (105) | 60 |

This cycle corresponds to an average speed of about 40 miles per hour, 64 km/hr.
*BHP = brake horsepower.

During the rating phase of the test, in which the engine's octane requirement is rated, the engine is run under disc control. The disc contains a recording of the intake manifold vacuum and engine speed of a car being accelerated according to the Coordinating Research Council (CRC) Octane Requirement Procedure. 1983 CRC reference fuels are used during the rating phase to determine the octane requirement of the engine. The reference fuels utilized in this test include a primary reference fuel (PRF), a full boiling range unleaded fuel (FBRU) and a full boiling range sensitive unleaded fuel (FBRSU).

To test an additive, the engine is run on the standard gasoline described in Table 1 until a stabilized or equilibrium octane requirement of the clean engine is obtained. During deposit build-up, octane requirements are evaluated after 2, 24 and 100 hours of operation and every 100 hours thereafter until the requirement of the engine stops increasing, i.e. equilibrium has been reached. A typical ORI test lasts from 400 to 600 hours. Operation for about 500 hours is equivalent to about 20,000 miles (32,189 km).

Upon the engine reaching an equilibrated octane requirement, the engine is switched to fuel containing the additive, run for 6 hours on the deposit accumulation cycle summarized in Talbe 2, and rerated for octane requirement. A comparison of the ratings before and after the engine is run on additive-containing fuel determines the effectiveness of the additive.

To show the effectiveness of the amine-ketone combination for the reduction of octane requirement, two separate combinations herein, one using equal parts of N,N-dibutyl formamide and methylcyclohexanone and one using equal parts of N,N-dibutyl formamide and benzophenone, are compared with Techron, a known ORR agent. The first set of four tests, Examples 1 to 4, compares 0.05 weight percent concentrations of each compound in the combination with 0.5 weight percent concentrations of Techron. The second set of tests, Examples 5 and 6, use concentrations of 0.5 weight percent of each the compounds in the combination. Results of the tests are summarized in Table 3.

TABLE 3

Difference in Octane Requirement After a Six-Hour Slug Treatment

| Ex. No. | Compound Tested (Wt. % added to Fuel) | Change in Octane Requirement PRF | FBRU | FBRSU |
|---|---|---|---|---|
| 1 | Benzophenone (0.05) and N,N—dibutyl formamide (0.05) | −1 | −1 | −1 |
| 2 | Methylcyclohexanone (0.05) and N,N—dibutyl formamide (0.05) | −1 | −1 | −1 |
| 3 | Techron or OGA 273 (0.5) | −1 | −1 | −1 |
| 4 | Techron or OGA 273 (0.5) | −1 | −1 | −1 |
| 5 | Methylcyclohexanone (0.5) and N,N—dibutyl formamide (0.5) | −1 | −1 | −1 |
| 6 | Benzophenone (0.5) and N,N—dibutyl formamide (0.5) | 0 | 0 | 0 |
| 7 | N,N—dibutyl formamide (0.5) | +2 | +2 | +2 |
| 8 | Methylcyclohexanone (0.5) | +1 | +2 | +2 |

The results show that combinations of N,N-dibutyl formamide and benzophenone and of methylcyclohexanone and N,N-dibutylformamide, when used in a concentration of 0.05 weight percent for each compound in the combination, achieve the same reduction in octane requirement as a 0.5 weight percent concentration of Techron, reduction of one Research Octane Number, in 6 hours of operation for each of the three CRC standard fuels used, PRF, FBRU and FBRSU. Therefore these combinations are equally effective for reducing the octane requirement of an equilibrium engine as Techron, the current industry standard. However, as illustrated by examples 5 and 6, when each of the additives is employed in the combination in a concentration of 0.5 weight percent, only the combination of methylcyclohexanone and N,N-dibutyl formamide is effective for reducing the octane requirement. The use of 0.5 weight percent of benzophenone in combination with the same concentration of the amide results in no decrease in octane requirement, while at 0.5 weight percent the same combination proves effective for reducing the octane requirement. (Whether the result at 0.5 weight percent is specific to benzophenone or is characteristic of aromatic ketones in general due to their known tendency to act as precursors to engine deposits is presently undetermined.) On the other hand, as is shown by examples 7 and 8, neither N,N-dibutyl formamide nor methylcyclohexanone used alone in a concentration of 0.5 weight percent is effective for reducing octane requirement. Instead the octane requirement of the engine increases by as much as two octane numbers when the compounds preferred for use in the combination are used alone at 5 times the total concentration of the combination used in Example 1.

EXAMPLE 2

An initially clean Oldsmobile Omega powered by a 2.5 liter 4-cylinder engine is utilized to compare the additive of the instant invention for the inhibition of octane requirement increase with Techron, the above described commercially available additive. The additives are added to the gasoline described in Table 1. The deposit accumulation phase and the rating phase employ the same set of conditions described in Table 2 except that when the engine reaches a stabilized octane requirement after being run using the fuel of Table 1, the fuel is switched to that containing the additive herein, the engine is run for 24 hours on fuel containing the additive, and then is rerated. A comparison of the ratings before and after the engine is run on additive-containing fuel determines the effectiveness of the additive.

Results of the tests, Examples 9 to 13, for ratings utilizing PRF, FBRU and FBRSU fuels are summarized in Table 4. Examples 9 and 10 employ Techron at a concentration of 0.5 weight percent. Examples 11 to 13 utilize an additive combination containing 0.25 weight percent of methylcyclohexanone and 0.25 weight percent of N,N-dibutylformamide. As shown by the data in Table 4, the additive combination of the invention once equalled and eight times outperformed Techron, the industry standard, for each of the standard test fuels employed.

TABLE 4

| Ex. No. | Compound(s) Tested (Concentration Wt. %) | Decrease in Octane Requirement After a 24-Hour Slug Treatment: Change in Octane Requirement PRF | FBRU | FBRSU |
|---|---|---|---|---|
| 9 | Techron (0.5) | −.5 | −1.0 | −1.0 |
| 10 | Techron (0.5) | −1.0 | −1.5 | −1.5 |
| 11 | Methylcyclohexanone (0.25) and N,N—dibutyl formamide (0.25) | −1.0 | −2.0 | −2.0 |
| 12 | Methylcyclohexanone (0.25) and N,N—dibutyl formamide (0.25) | −1.5 | −2.0 | −2.0 |
| 13 | Methylcyclohexanone (0.25) and N,N—dibutyl formamide (0.25) | −3.5 | −3.0 | −3.0 |

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and scope of the claims.

We claim:

1. A fuel composition comprising gasoline, a ketone dissolved therein, and an amide dissolved therein, the ketone and amide being, in combination, present in an amount effective for inhibiting octane requirement increase, wherein the amide is of formula:

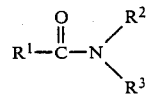

wherein $R^1$, $R^2$, and $R^3$ are organic groups or hydrogen, provided that not all three of $R^1$, $R^2$, and $R^3$ are hydrogen, and wherein the ketone is of either formula:

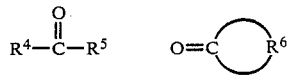

(I) (II)

wherein $R^4$, $R^5$, and $R^6$ are organic radicals.

2. A fuel composition as defined in claim 1 wherein said ketone has no more than about 75 carbon atoms and the amide no more than 121.

3. A fuel composition as defined in claim 1 wherein said ketone is an aromatic ketone and said amide is a formamide or acetamide.

4. A fuel composition as defined in claim 3 wherein the ketone contains no more than 75 carbon atoms and the amide no more than 121 carbon atoms.

5. A fuel composition as defined in claim 1 wherein said gasoline consists essentially of unleaded gasoline.

6. A fuel composition as defined in claim 2 wherein each of $R^1$, $R^2$, and $R^3$ contains no more than 40 carbon atoms, and $R^4$ and $R^5$ together contain no more than about 49 carbon atoms and $R^6$ contains no more than about 49 carbon atoms.

7. A fuel composition as defined in claim 2 wherein said gasoline consists essentially of unleaded gasoline.

8. A method for operating a spark ignition internal combustion engine which comprises combusting in said engine the fuel composition of claim 2.

9. A fuel composition as defined in claim 6 wherein $R^1$, $R^2$, and $R^3$ are selected from the group consisting of hydrogen, hydrocarbons, and oxyhydrocarbons, provided that no more than two of said $R^1$, $R^2$, and $R^3$ is hydrogen, and $R^4$, $R^5$, and $R^6$ are selected from the group consisting of hydrocarbons and oxyhydrocarbons.

10. A method for operating a spark ignition internal combustion engine which comprises combusting in said engine the fuel composition of claim 6.

11. A fuel composition as defined in claim 9 wherein $R^1$, $R^2$, and $R^3$ are selected individually from the group consisting of alkyl groups and hydrogen, provided that no more than two of $R^1$, $R^2$, and $R^3$ are hydrogen, and $R^4$, $R^5$, and $R^6$ are hydrocarbons.

12. A method for operating a spark ignition internal combustion engine which comprises combusting in said engine the fuel composition of claim 11.

13. A fuel composition as defined in claim 9 wherein said gasoline consists essentially of unleaded gasoline.

14. A fuel composition as defined in claim 11 wherein the ketone conforms to formula (II) and $R^6$ is a cycloalkyl or alkyl- or polyalkyl-substituted cycloalkyl radical.

15. A fuel composition as defined in claim 14 wherein said gasoline consists essentially of unleaded gasoline.

16. A fuel composition as defined in claim 11 wherein the ketone conforms to formula (I) and $R^4$ and $R^5$ are either alkyl groups or aromatic groups.

17. A fuel composition as defined in claim 16 wherein the $R^4$ and $R^5$ are unsubstituted phenyl groups or phenyl groups containing alkyl substituents.

18. A fuel composition as defined in claim 17 wherein said gasoline consists essentially of unleaded gasoline.

19. A fuel composition as defined in claim 16 wherein $R^4$ and $R^5$ are both unsubstituted, acyclic, alkyl groups.

20. A method for operating a spark ignition internal combustion engine which comprises combusting in said engine the fuel composition of claim 19.

21. A method for operating a spark ignition internal combustion engine which comprises combusting in said engine the fuel composition of claim 16.

22. A fuel composition comprising gasoline and at least 0.002 weight percent of a gasoline-soluble ketone and at least 0.002 weight percent of a gasoline-soluble amide, wherein the amide is of formula:

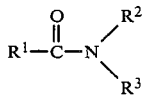

wherein $R^1$, $R^2$, and $R^3$ are organic groups or hydrogen, provided that not all three of $R^1$, $R^2$, and $R^3$ are hydrogen, and wherein the ketone is of either formula:

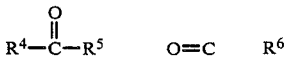

(I) (II)

wherein $R^4$, $R^5$, and $R^6$ are organic radicals.

23. A fuel composition as defined in claim 22 wherein each of $R^1$, $R^2$, and $R^3$ contains no more than 40 carbon atoms, and $R^4$ and $R^5$ together contain no more than about 49 carbon atoms and $R^6$ contains no more than about 49 carbon atoms.

24. A method for operating a spark ignition internal combustion engine which comprises combusting in said engine the fuel composition of claim 22.

25. A fuel composition as defined in claim 23 wherein $R^1$, $R^2$, and $R^3$ are selected from the group consisting of hydrogen, hydrocarbons, and oxyhydrocarbons, provided that no more than two of said $R^1$, $R^2$, and $R^3$ is hydrogen, and $R^4$, $R^5$, and $R^6$ are selected from the group consisting of hydrocarbons and oxyhydrocarbons.

26. A fuel composition as defined in claim 23 wherein said gasoline consists essentially of unleaded gasoline.

27. A fuel composition as defined in claim in 25 wherein $R^1$, $R^2$, and $R^3$ are selected individually from the group consisting of alkyl groups and hydrogen, provided that no more than two of $R^1$, $R^2$, and $R^3$ are hydrogen, and $R^4$, $R^5$, and $R^6$ are hydrocarbons.

28. A method for operating a spark ignition internal combustion engine which comprises combusting in said engine the fuel composition of claim 25.

29. A fuel composition as defined in claim 27 wherein the ketone conforms to formula (II) and $R^6$ is a cycloalkyl or alkyl- or polyalkyl-substituted cycloalkyl radical.

30. A method for operating a spark ignition internal combustion engine which comprises combusting in said engine the fuel composition of claim 29.

31. A fuel composition as defined in claim 27 wherein the ketone conforms to formula (I) and $R^4$ and $R^5$ are either alkyl groups or aromatic groups.

32. A fuel composition as defined in claim 27 wherein said gasoline consists essentially of unleaded gasoline.

33. A fuel composition as defined in claim 31 wherein said gasoline consists essentially of unleaded gasoline.

34. A method for operating a spark ignition internal combustion engine which comprises combusting in said engine the fuel composition of claim 33.

35. A fuel composition as defined in claim 31 wherein the $R^4$ and $R^5$ are unsubstituted phenyl groups or phenyl groups containing alkyl substituents.

36. A method for operating a spark ignition internal combustion engine which comprises combusting in said engine the fuel composition of claim 35.

37. A fuel composition as defined in claim 31 wherein $R^4$ and $R^5$ are both unsubstituted, acyclic, alkyl groups.

38. A fuel composition as defined in claim 37 wherein said gasoline consists essentially of unleaded gasoline.

39. A method for operating a spark ignition internal combustion engine which comprises combusting in said engine the fuel composition of claim 38.

40. A fuel composition comprising gasoline and both a ketone and an amide dissolved therein, wherein said ketone and amide are present in proportions of at least 0.002 weight percent each, and said ketone is selected from the group consisting of 2-pentanone, 1-penten-3-one, 1-pentyn-3-one, 2-hexanone, acetone, 2-butanone, ethylacetoacetone, 2-decanone, 4-decanone, 3-heptanone, 1-hexen-3-one, 5-hexen-2-one, 2-pentanone, 1-hexyn-3-one, methylcyclohexanone, ethyl-methyl benzophenone, propyl-butyl benzophenone, dimethyl benzophenone, cyclopentanone, trimethyl benzophenone, ethyl-methyl cyclopentanone, propyl-butyl cyclopentanone, and dibutyl cyclopentanone, and said amide is selected from the group consisting of N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N,N-dibutyl acetamide, N,N-dipropyl acetamide, N-ethyl-N-decyl acetamide, and N-nonyl-N-decyl acetamide.

41. A fuel composition as defined in claim 40 wherein said gasoline consists essentially of unleaded gasoline.

42. A method for operating a spark ignition internal combustion engine which comprises combusting in said engine the fuel composition of claim 41.

43. A method for operating a spark ignition internal combustion engine which comprises combusting in said engine the fuel composition of claim 40.

* * * * *

UNITED STATES PATENT AND TRADEMARK OFFICE

CERTIFICATE OF CORRECTION

PATENT NO. : 4,844,717

DATED : July 4, 1989

INVENTOR(S) : Michael C. Croudace, Timothy Wusz, and Stephen Brass

It is certified that error appears in the above-identified patent and that said Letters Patent is hereby corrected as shown below:

Column 10, line 37, after "$R^5$" add --or--.

Column 11, line 53, after "$R^5$" add --or--; add arcs between "O = C" and "$R^6$", i.e., O = C $R^6$.

Signed and Sealed this

Twenty-first Day of August, 1990

*Attest:*

HARRY F. MANBECK, JR.

*Attesting Officer*

*Commissioner of Patents and Trademarks*